US011530906B2

(12) United States Patent
Emary

(10) Patent No.: US 11,530,906 B2
(45) Date of Patent: Dec. 20, 2022

(54) BULLET WITH CONTROLLED FRAGMENTATION

(71) Applicant: Hornady Manufacturing Company, Grand Island, NE (US)

(72) Inventor: David E. Emary, St. Paul, NE (US)

(73) Assignee: HORNADY MANUFACTURING COMPANY, Grand Island, NE (US)

( * ) Notice: Subject to any disclaimer, the term of this patent is extended or adjusted under 35 U.S.C. 154(b) by 0 days.

(21) Appl. No.: 16/724,304

(22) Filed: Dec. 22, 2019

(65) Prior Publication Data

US 2020/0284564 A1 Sep. 10, 2020

Related U.S. Application Data

(63) Continuation of application No. 15/957,967, filed on Apr. 20, 2018, now Pat. No. 10,563,964, which is a continuation of application No. 15/596,143, filed on May 16, 2017, now Pat. No. 9,982,980, which is a continuation of application No. 15/168,187, filed on May 30, 2016, now Pat. No. 9,658,042, which is a continuation of application No. 14/828,469, filed on Aug. 17, 2015, now Pat. No. 9,360,287, which is a continuation of application No. 14/071,351, filed on Nov. 4, 2013, now Pat. No. 9,121,677.

(60) Provisional application No. 61/881,371, filed on Sep. 23, 2013.

(51) Int. Cl.

| | |
|---|---|
| ***F42B 12/34*** | (2006.01) |
| ***F42B 12/02*** | (2006.01) |
| ***F42B 14/02*** | (2006.01) |
| ***F42B 12/24*** | (2006.01) |
| ***F42B 12/78*** | (2006.01) |

(52) U.S. Cl.

CPC ..... *F42B 12/34* (2013.01); *F42B 12/02* (2013.01); *F42B 12/24* (2013.01); *F42B 12/78* (2013.01); *F42B 14/02* (2013.01)

(58) Field of Classification Search

CPC ..... F42B 12/34
USPC ..... 102/506–510, 514–516
See application file for complete search history.

(56) References Cited

U.S. PATENT DOCUMENTS 9,121,677 B2 * 9/2015 Emary ..... F42B 12/24

* cited by examiner

*Primary Examiner* — Reginald S Tillman, Jr.
(74) *Attorney, Agent, or Firm* — Bennet K. Langlotz; Langlotz Patent & Trademark Works, LLC

(57) ABSTRACT

A bullet with controlled fragmentation has a core in the form of a generally cylindrical body having a forward end and a rear end and intermediate side portions extending there between, the forward end of the core defining a cavity, a jacket encompassing the rear end and at least selected portions of the sides of the core, the jacket having a sidewall having a first drive band portion having a first wall thickness, and a second portion immediately forward of the drive band portion having a second thickness less than the first thickness, the exterior of the jacket defining a cannelure groove encircling the bullet, and the cannelure groove being positioned forward of the first drive band portion. The drive band may have forward edge defining a step. The bullet of the present invention may also be received in the case mouth of a rimless case and be partially protruding therefrom.

1 Claim, 14 Drawing Sheets

BULLET WITH CONTROLLED FRAGMENTATION

CROSS-REFERENCE TO RELATED APPLICATIONS

This is a Continuation of U.S. patent application Ser. No. 15/957,967 filed on Apr. 20, 2018, entitled "BULLET WITH CONTROLLED FRAGMENTATION," which is a Continuation of U.S. patent application Ser. No. 15/596,143 filed on May 16, 2017, now issued as U.S. Pat. No. 9,982,980, entitled "BULLET WITH CONTROLLED FRAGMENTATION," which is a Continuation of U.S. patent application Ser. No. 15/168,187 filed on May 30, 2016, now issued as U.S. Pat. No. 9,658,042, entitled "BULLET WITH CONTROLLED FRAGMENTATION," which is a Continuation of U.S. patent application Ser. No. 14/828,469 filed on Aug. 17, 2015, now issued as U.S. Pat. No. 9,360,287, entitled "BULLET WITH CONTROLLED FRAGMENTATION," which is a Continuation of U.S. patent application Ser. No. 14/071,351 filed on Nov. 4, 2013, now issued as U.S. Pat. No. 9,121,677, entitled "BULLET WITH CONTROLLED FRAGMENTATION," which claims priority to U.S. Provisional Application Ser. No. 61/881,371 filed Sep. 23, 2013, and entitled "BULLET WITH CONTROLLED FRAGMENTATION."

FIELD OF THE INVENTION

The present invention relates to bullets, and more particularly to pistol bullets with features that affect the expansion and penetration characteristics of the bullets after striking barriers.

BACKGROUND OF THE INVENTION

Bullets used for law enforcement and self-defense are normally designed to provide a desired performance in terms of penetration and expansion. Expansion generates a larger wound channel, thereby more rapidly disabling a threat. Penetration is desirable to a degree to provide a deeper wound channel. Under penetration or excessive penetration is not desired because of the risk of lack of incapacitation or risk to innocents behind the target threat, and because of the energy wasted in a bullet that continues beyond the threat.

Law enforcement personnel are particularly concerned with the effectiveness of bullets on a threat that is behind a barrier. Typical bullet performance tests include positioning a block of ballistic gelatin behind a barrier, and then measuring the penetration of the gelatin by a bullet that passes through the barrier. Barriers may include two layers of gypsum wallboard (simulating a residential wall), 2 layers of sheet metal (simulating a car door), a sheet of ¾" plywood, and a sheet of auto glass. These tests represent the reality that law enforcement officers may need to stop a criminal threat which is barricaded behind such barriers (unlike self-defense situations, where a barricaded threat can more realistically be fled).

Ideally, the bullet penetrates a block of gelatin by at least 12" after passing through the barrier. This is a challenge for conventional hollow-point rounds designed to expand on first contact (typically, with flesh) because these soft and fragile bullets that expand readily are more likely to fragment or otherwise be distorted by the barrier, leaving a less-lethal resulting portion that may penetrate insufficiently.

Typical hollow point design bullets also tend to perform inconsistently. The damage suffered by the bullet upon striking the barrier is widely inconsistent, which means subsequent gel penetration is also inconsistent (often being inadequate) to be considered effective. There is also inconsistency for typical bullets as they perform on different barriers. One design might be effective after passing through drywall or plywood, but ineffective after penetrating auto glass (which is considered to be one of the most challenging elements of bullet performance tests). Bullets that perform well on bare or clothed gel alone (soft and easily-expanding bullets) often perform poorly on hard barrier tests. Bullets that perform well on barriers (solid bullets and bullets made from hard alloys of lead) tend to over penetrate dangerously on bare or clothed gelatin (where penetration in excess of 18-24" is considered dangerous).

As shown in U.S. Pat. No. 8,161,885 to Emary, the disclosure of which is incorporated by reference herein, hollow point bullets are found to perform more effectively when the cavity is filled with an elastomeric nose element. The elastomeric nose element allows the use of harder lead alloy bullets than are normally considered suitable for expanding pistol bullets, which normally use soft pure lead. The elastomer-filled cavity bullets allow the use of harder alloys because the elastomeric nose insert provides a force to expand the bullet. Along with being unusually effective, the hard lead alloy bullets also increase consistency and post-barrier performance in these bullets.

As background, it is noted that certain bullets are provided with a "cannelure," which is a circumferential groove typically made to a limited depth in the jacket, which happens to deflect the jacket slightly inward when formed. Cannelures are used in rifle bullets (which are seated in a chamber based on the position of the shoulder of a bottlenecked cartridge) to enable the case mouth edges to be deformed inward into the cannelure to securely grip the bullet. This is important during recoil when prior rounds are fired. Cannelures are also used for higher-powered, rimmed revolver bullets, such as 357 and 44 Magnum calibers, which are axially located in the cylinder of a revolver by the rims. These cartridges generate substantial recoil, and the cannelure secures the bullet.

Cannelures are not used for bullets used with auto-loading pistol cartridges such as 0.45 ACP, 0.40 S&W, and 9 mm Luger. The recoil forces are not significant enough to make the cannelure necessary, and more importantly, such cartridges headspace at the case mouth. This means the case mouth provides a ledge that stops against a ledge in the pistol chamber when the round is fully chambered. Cannelures have not been used in automatic pistol cartridges because great care must be taken to make sure the case mouth is not excessively bent inward into the cannelure as in other cannelured cartridges, and thus fail to present an edge to engage the ledge in the chamber. In the absence of a sufficient ledge on the case mouth, the cartridge would insert excessively. Either primer strikes might not be effective (resulting in a failure to fire), or excess space between the base of the case and the face of the bolt would cause the case to be unsupported, and thus prone to case separations, with the attendant risk to the shooter and potential inability to fire critical follow-up shots.

Moreover, forming cannelures in bullets when not required makes the cartridge manufacturing process more challenging because of the need to more precisely set the insertion depth of each bullet to put the cannelure at the right location with respect to the case mouth.

Therefore, a need exists for a new and improved pistol bullet that penetrates a variety of barriers, but does not over penetrate bare or clothed gelatin. In this regard, the various embodiments of the present invention substantially fulfill at least some of these needs. In this respect, the ballistic barrier according to the present invention substantially departs from the conventional concepts and designs of the prior art, and in doing so provides an apparatus primarily developed for the purpose of penetrating a variety of barriers without over penetrating bare or clothed gelatin.

SUMMARY OF THE INVENTION

The present invention provides an improved pistol bullet, and overcomes the above-mentioned disadvantages and drawbacks of the prior art. As such, the general purpose of the present invention, which will be described subsequently in greater detail, is to provide an improved pistol bullet that has all the advantages of the prior art mentioned above.

To attain this, the preferred embodiment of the present invention essentially comprises a core in the form of a generally cylindrical body having a forward end and a rear end and intermediate side portions extending therebetween, the forward end of the core defining a cavity, a jacket encompassing the rear end and at least selected portions of the sides of the core, the jacket having a sidewall having a first drive band portion having a first wall thickness, and a second portion immediately forward of the drive band portion having a second thickness less than the first thickness, the exterior of the jacket defining a cannelure groove encircling the bullet, and the cannelure groove being positioned forward of the first drive band portion. The drive band may have forward edge defining a step. The bullet of the present invention may also be received in the case mouth of a rimless case and be partially protruding therefrom. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
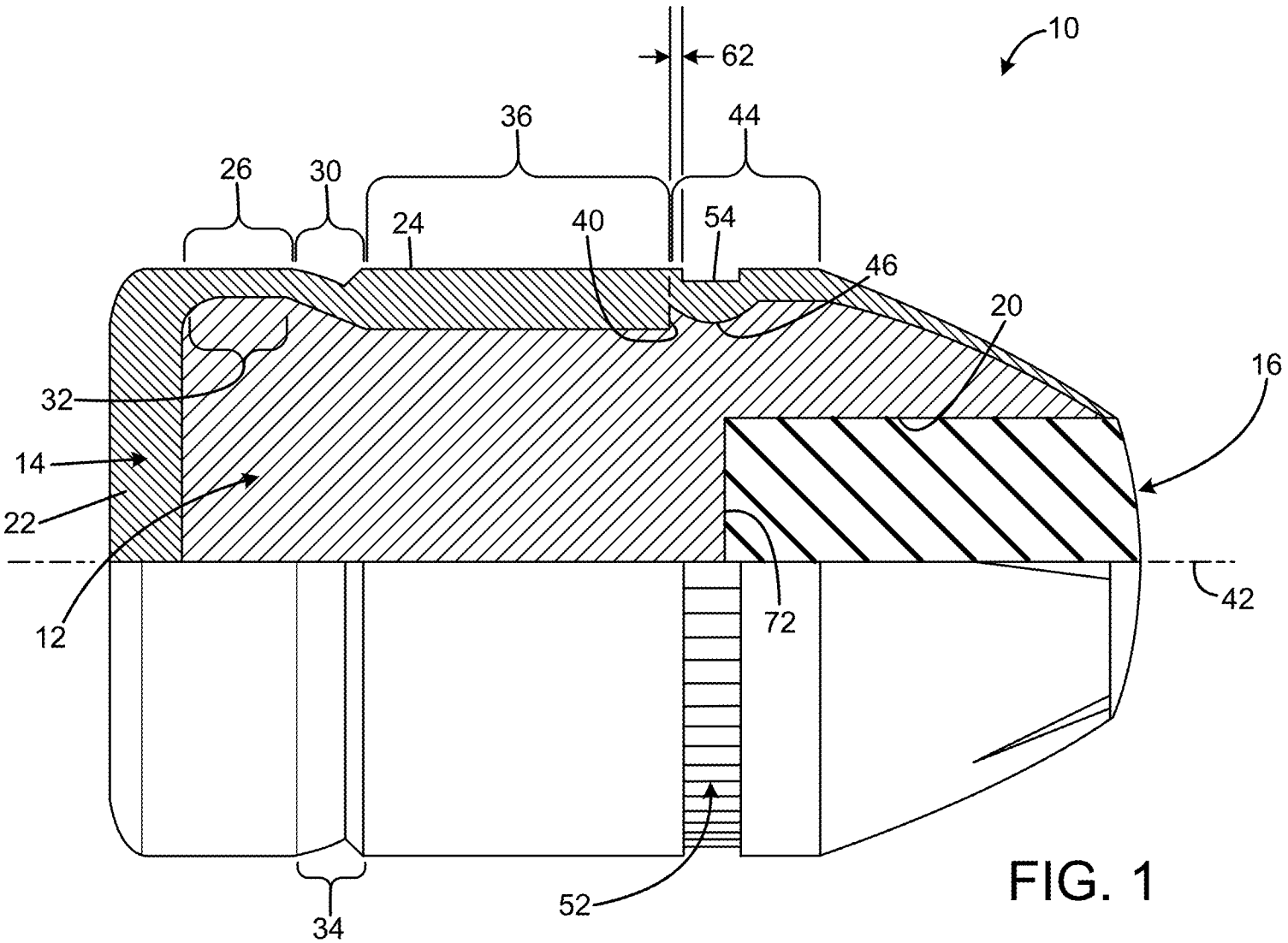
FIG. 1 is a side partially cutaway view of the current embodiment of a 0.40 caliber pistol bullet constructed in accordance with the principles of the present invention.

An embodiment of a bullet of the present invention is shown and generally designated by the reference numeral 10.

FIG. 1 illustrates a bullet 10 of the present invention. More particularly, the bullet is for a 0.40 (40 S&W) caliber pistol. The bullet includes a lead alloy core 12, a copper jacket 14, and a cylindrical elastomeric nose insert 16 received within a cavity 20 at the forward end of the core. The jacket surrounds the side and rear of the core, and is open at the front end.

The jacket has a generally flat rear base portion 22 and a cylindrical sidewall 24 with the illustrated profile. Starting from the base 22, the sidewall has a first portion 26 with a relatively thin wall thickness, and surrounding an enlarged-diameter base portion 32 of the core. A second wall portion 30 has an exterior groove 34 with a V-shape, and a sloping interior surface that transitions to the thicker wall of the band or interlock portion 36. This has a narrower interior diameter than the base portion 32 of the core so the core is locked into the jacket. The thickness of the band portion provides structural integrity even upon impact and penetration of barriers.

Figure 2:
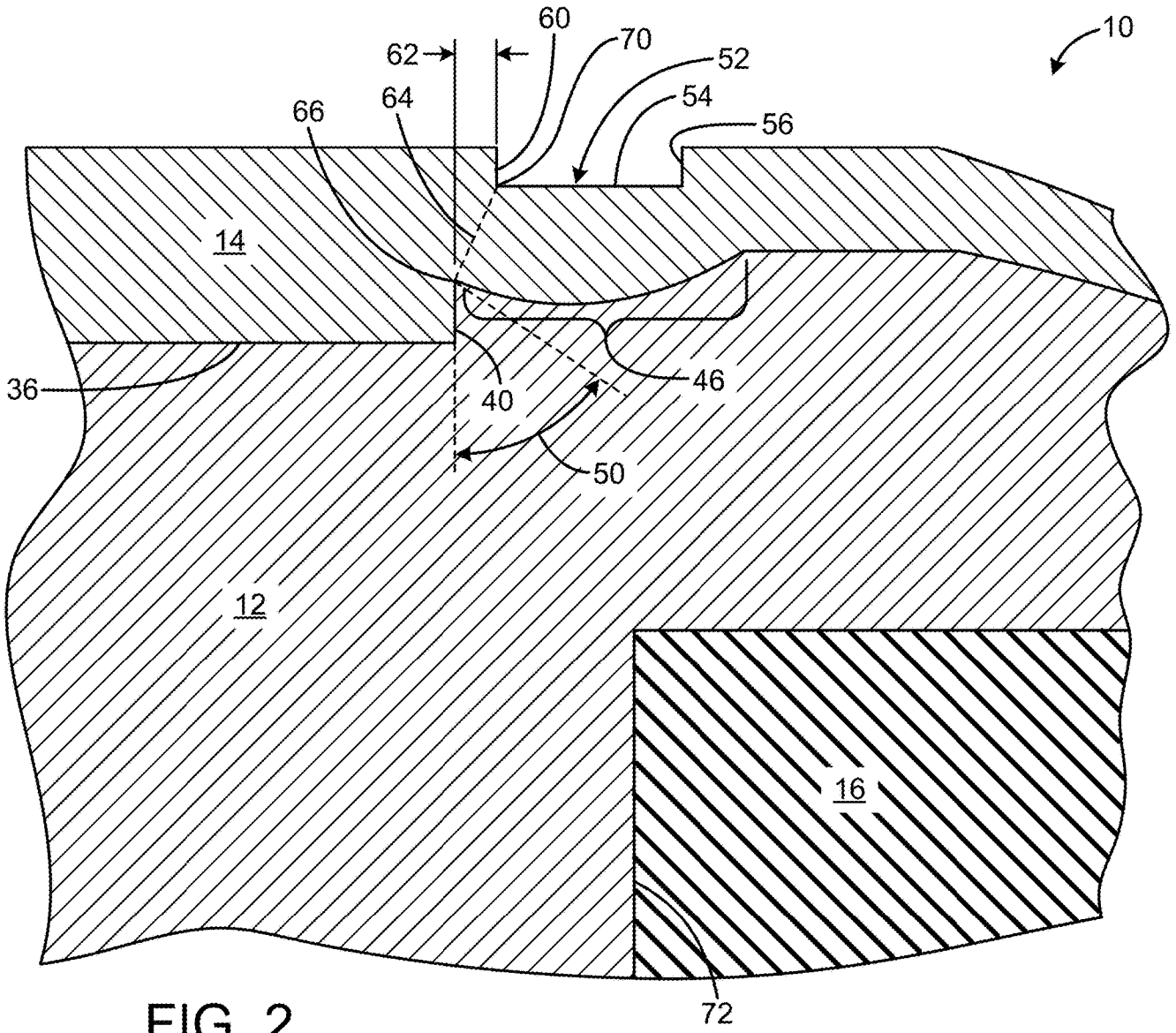
FIG. 2 is an enlarged view of the cutaway portion of the current embodiment of the 0.40 caliber pistol bullet of FIG. 1 with the cannelure in the optimum position relative to the lock band.

The band 36 terminates at a forward end at a ledge 40 that is perpendicular to the axis 42 of the bullet, and parallel to the base 22. This ledge provides an abrupt transition to a thinner forward jacket portion 44. Forward of the ledge, the interior of the jacket bulges inward with a circumferential convex toroidal bulge 46 that is formed by the canneluring process as will be discussed below. Because the bulge is adjacent to the ledge 40, the rearmost portion of the bulge surface meets the ledge at an acute angle 50 as shown in FIG. 2. In the preferred embodiment, this acute angle is about 60°, but it may range from 30 to 80° to be effective as a stress concentration feature that enables the band of the jacket to retain integrity while the portion forward of the band may fragment off upon striking a barrier.

As is also shown in FIG. 2, a cannelure 52 is formed as a circumferential groove with a serrated bottom 54, a flat, rear facing forward wall 56, and a flat forward facing front wall 60. The distance 62 between the rear wall 60 and the ledge 40 of the band is indicated by number 62. The cannelure rear wall is forward of the ledge, but by a limited distance of 0.005-0.015 inches.

Figure 3:
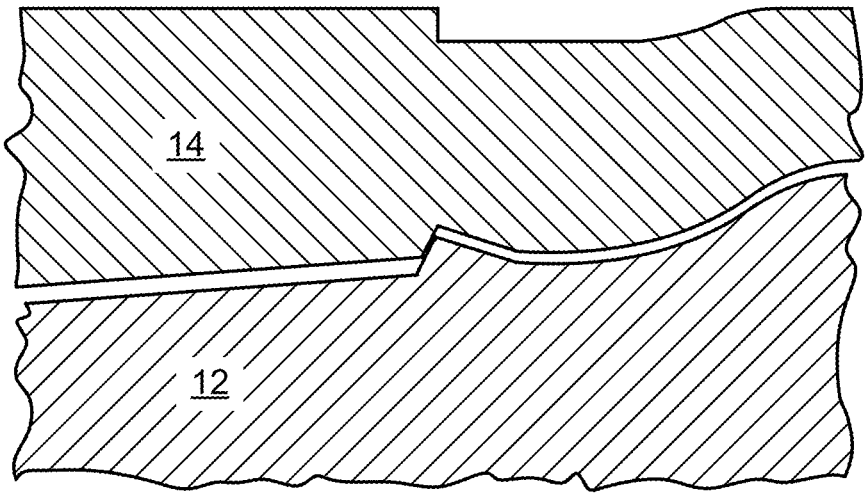
FIG. 3 is an enlarged side sectional view of a 0.40 caliber pistol bullet with the cannelure in a suboptimal position that is too close to the lock band.
Figure 4:
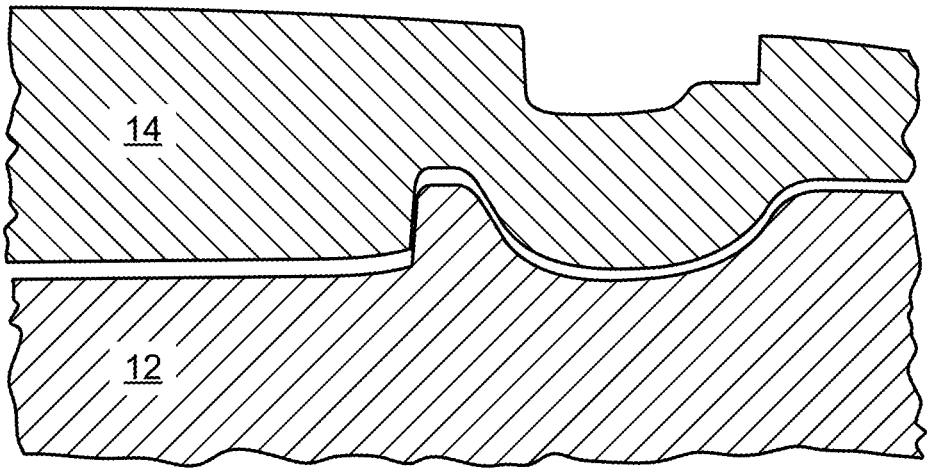
FIG. 4 is an enlarged side sectional view of a 0.40 caliber pistol bullet with the cannelure in a suboptimal position that is too far from the lock band.

When the distance is less than 0.005 inch, the process of forming the cannelure 52 simply crushes the jacket wall, and pushed the ledge of the band inward, so that the acute angle 50 is not formed. When the cannelure begins more than 0.010 inch forward of the ledge, then the bulge does not reach the ledge, and the angle formed is essentially square, not acute. Moreover, greater distances mean the line of fracture 64 is extended too far forward and does not provide an adequate fracture point. FIG. 2 shows the angle area with the proper dimensioning of the distance 62. FIG. 3 shows when the distance is too small, and FIG. 4 shows when the distance is too great. In the cases where the distance is not within the optimal range, the core 12 and jacket 14 material above cannelure 52 do not break off cleanly, which results in a projectile with excessive frontal area that does not sufficiently penetrate the gelatin.

With a jacket 14 wall thickness (before canneluring) of about 0.020 inch, the distance 62 is ½ to ¼ the wall thickness. This creates a line of fracture 64 between the vertex 66 of the acute angle 50, and the rear inner corner 70 of the cannelure 52. In the preferred embodiment, the cannelure tool is provided with a sharp edge that is not relieved or rolled, so as to profile a sharp corner 70 for maximum stress concentration to facilitate breakage in this area. With the line 64 angling outward and forward, it forms an angle with respect to the sidewall of about 70°. This is preferably in the range of 45 to 80°.

Figure 5:
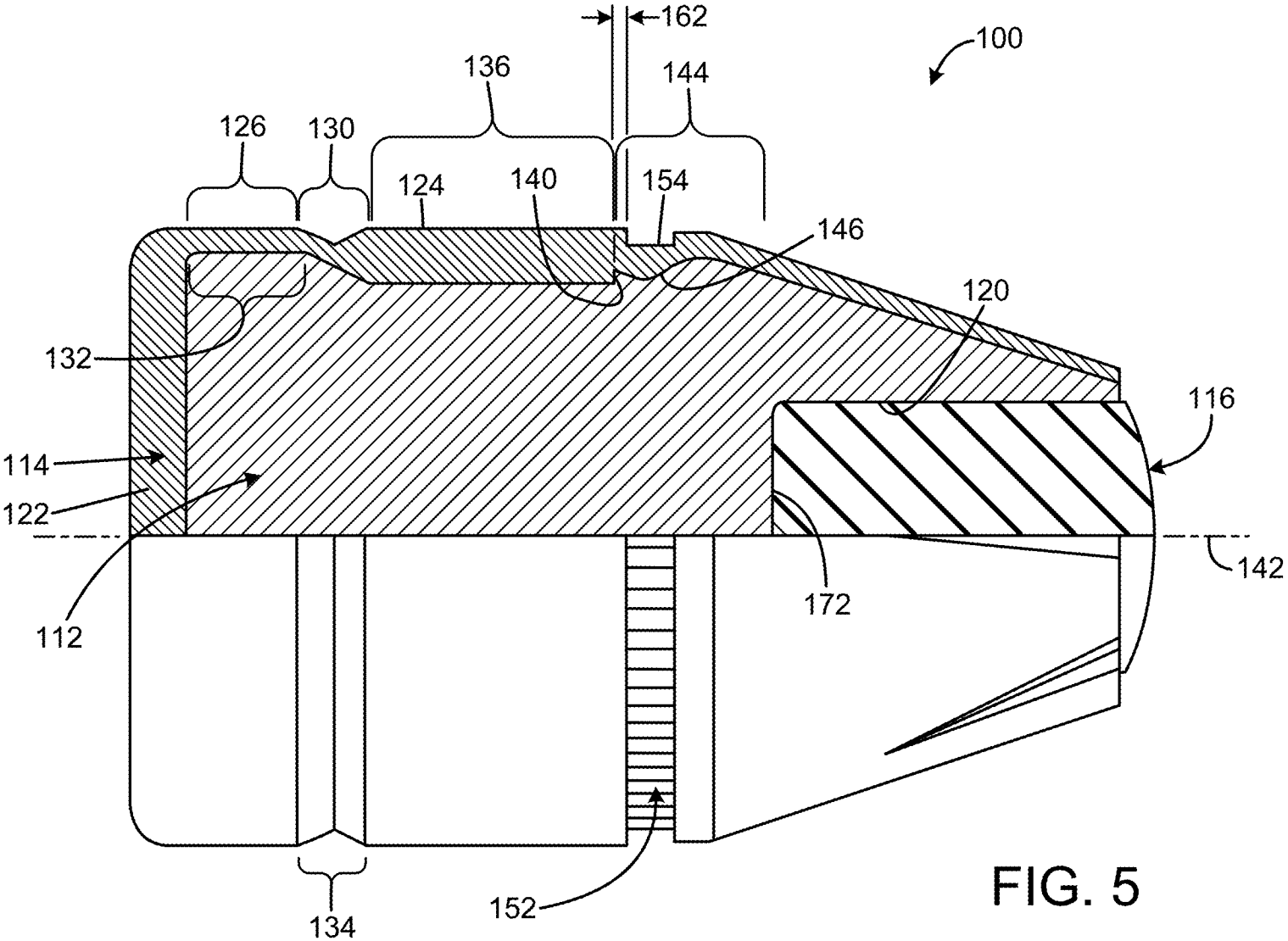
FIG. 5 is a side partially cutaway view of the current embodiment of a 0.45 caliber pistol bullet constructed in accordance with the principles of the present invention.

FIG. 5 illustrates a bullet 100 of the present invention. More particularly, the bullet is for a 0.45 (45 ACP) caliber pistol. The bullet includes a lead alloy core 112, a copper jacket 114, and a cylindrical elastomeric nose insert 116 received within a cavity 120 at the forward end of the core. The jacket surrounds the side and rear of the core, and is open at the front end.

The jacket has a generally flat rear base portion 122 and a cylindrical sidewall 124 with the illustrated profile. Starting from the base 122, the sidewall has a first portion 126 with a relatively thin wall thickness, and surrounding an enlarged-diameter base portion 132 of the core. A second wall portion 130 has an exterior groove 134 with a V-shape, and a sloping interior surface that transitions to the thicker wall of the band or interlock portion 136. This has a narrower interior diameter than the base portion 132 of the core so the core is locked into the jacket. The thickness of the band portion provides structural integrity even upon impact and penetration of barriers.

Figure 6:
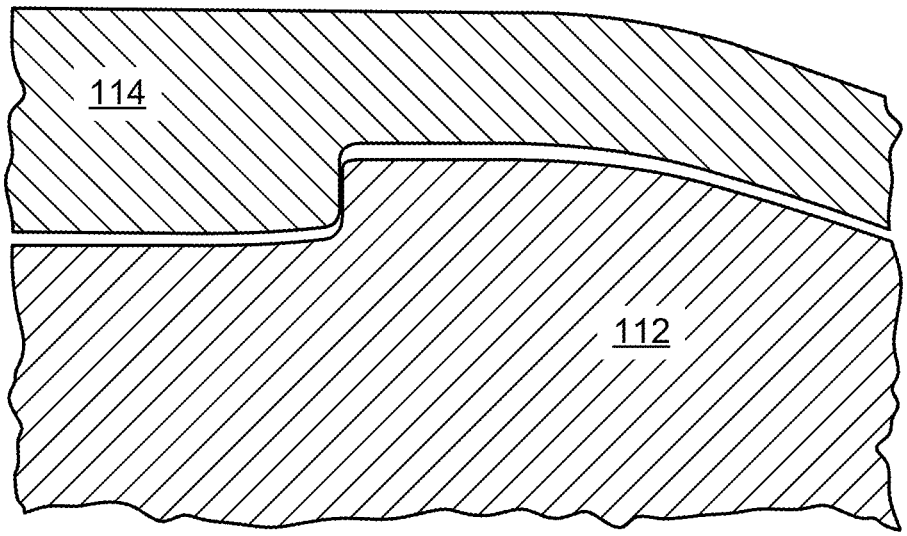
FIG. 6 is an enlarged view of the cutaway portion of the current embodiment of the 0.45 caliber pistol bullet of FIG. 5 prior to creation of the cannelure.
Figure 7:
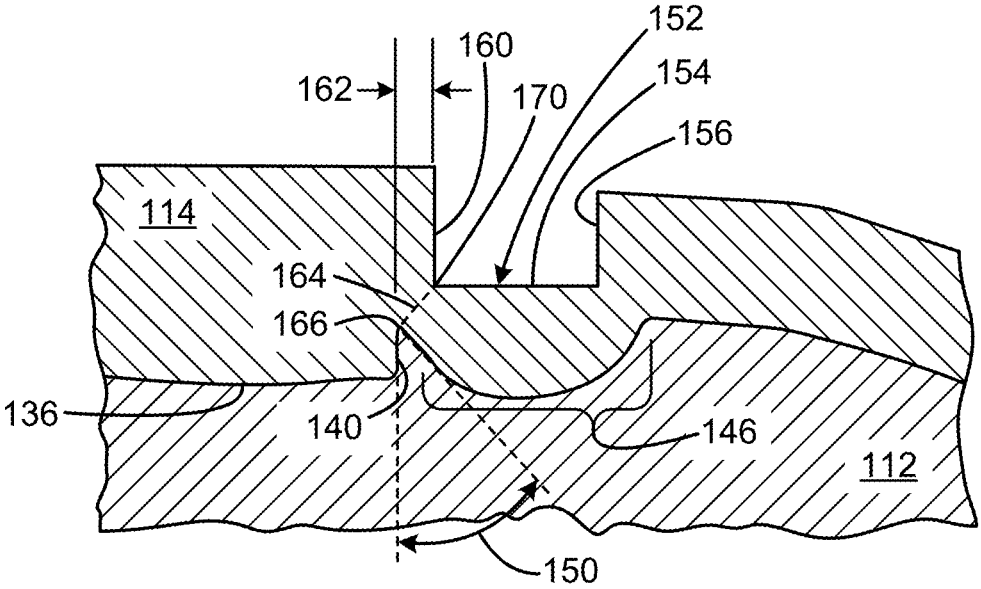
FIG. 7 is an enlarged view of the cutaway portion of the current embodiment of the 0.45 caliber pistol bullet of FIG. 5.

FIG. 6 shows the bullet 100 prior to the initiation of the canneluring process, and FIG. 7 shows the bullet 100 after completion of the canneluring process. In the process of forming the cannelure 152, after the core 112 is swaged into the jacket 114, the internal surface and structure of the bullet is disrupted from a smooth cylindrical junction between core and jacket just forward of the ledge (FIG. 6), to the internal bulge (FIG. 7). The depth, location, and sharpness of the cannelure must all be precisely manufactured using draw punches to obtain the desired barrier penetration results. The same canneluring process applies to bullets 10, 200, 300, 400 (shown in FIGS. 1, 8, 10B, and 10C).

The band 136 terminates at a forward end at a ledge 140 that is perpendicular to the axis 142 of the bullet, and parallel to the base 122. This ledge provides an abrupt transition to a thinner forward jacket portion 144. Forward of the ledge, the interior of the jacket bulges inward with a circumferential convex toroidal bulge 146 that is formed by the canneluring process as will be discussed below. Because the bulge is adjacent to the ledge 140, the rearmost portion of the bulge surface meets the ledge at an acute angle 150. In the preferred embodiment, this acute angle is about 60°, but it may range from 30 to 80° to be effective as a stress concentration feature that enables the band of the jacket to retain integrity while the portion forward of the band may fragment off upon striking a barrier.

As is also shown in FIG. 7, a cannelure 152 is formed as a circumferential groove with a serrated bottom 154, a flat, rear facing forward wall 156, and a flat forward facing front wall 160. The distance 162 between the rear wall 160 and the ledge 140 of the band is indicated by number 162. The cannelure rear wall is forward of the ledge, but by a limited distance of 0.005-0.015 inches.

When the distance is less than 0.005 inch, the process of forming the cannelure 152 simply crushes the jacket wall, and pushed the ledge of the band inward, so that the acute angle 150 is not formed. When the cannelure begins more than 0.010 inch forward of the ledge, then the bulge does not reach the ledge, and the angle formed is essentially square, not acute. Moreover, greater distances mean the line of fracture 164 is extended too far forward and does not provide an adequate fracture point. FIG. 7 shows the angle area with the proper dimensioning of the distance 162. In the cases where the distance is not within the optimal range, the core 112 and jacket 114 material above cannelure 152 do not break off cleanly, which results in a projectile with excessive frontal area that does not sufficiently penetrate the gelatin.

With a jacket 114 wall thickness (before canneluring) of about 0.020 inch, the distance 162 is ½ to ¼ the wall thickness. This creates a line of fracture 164 between the vertex 166 of the acute angle 150, and the rear inner corner 170 of the cannelure 152. In the preferred embodiment, the cannelure tool is provided with a sharp edge that is not relieved or rolled, so as to profile a sharp corner 170 for maximum stress concentration to facilitate breakage in this area. With the line 164 angling outward and forward, it forms an angle with respect to the sidewall of about 70°. This is preferably in the range of 45 to 80°.

Figure 8:
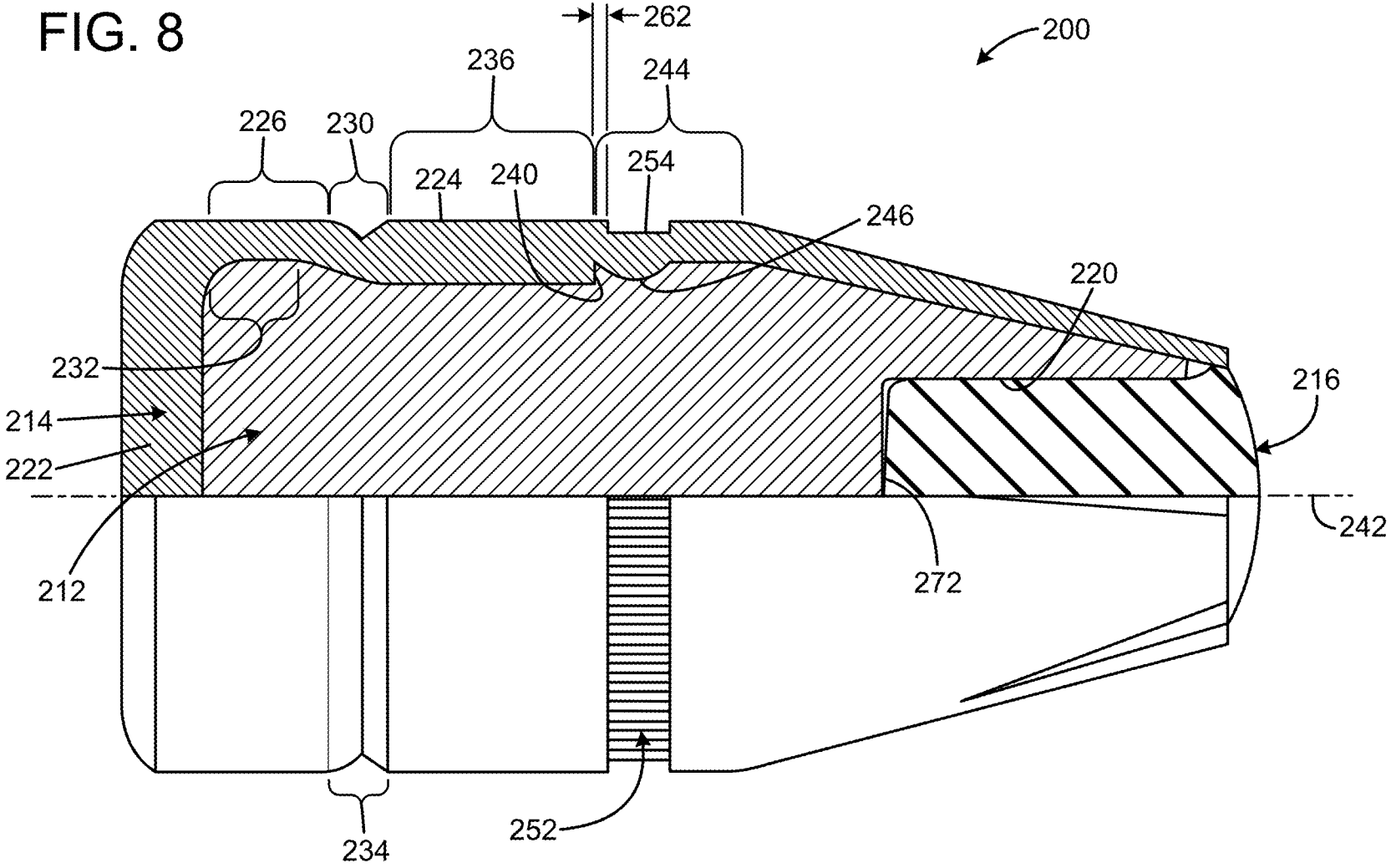
FIG. 8 is a side partially cutaway view of the current embodiment of a 9 mm pistol bullet constructed in accordance with the principles of the present invention.

FIG. 8 illustrates a bullet 100 of the present invention. More particularly, the bullet is for a 9 mm (9 mm Luger) caliber pistol. The bullet includes a lead alloy core 212, a copper jacket 214, and a cylindrical elastomeric nose insert 216 received within a cavity 220 at the forward end of the core. The jacket surrounds the side and rear of the core, and is open at the front end.

The jacket has a generally flat rear base portion 222 and a cylindrical sidewall 224 with the illustrated profile. Starting from the base 222, the sidewall has a first portion 226 with a relatively thin wall thickness, and surrounding an enlarged-diameter base portion 232 of the core. A second wall portion 230 has an exterior groove 234 with a V-shape, and a sloping interior surface that transitions to the thicker wall of the band or interlock portion 136. This has a narrower interior diameter than the base portion 232 of the core so the core is locked into the jacket. The thickness of the band portion provides structural integrity even upon impact and penetration of barriers.

The band 236 terminates at a forward end at a ledge 240 that is perpendicular to the axis 242 of the bullet, and parallel to the base 222. This ledge provides an abrupt transition to a thinner forward jacket portion 244. Forward of the ledge, the interior of the jacket bulges inward with a circumferential convex toroidal bulge 246 that is formed by the canneluring process as will be discussed below. Because the bulge is adjacent to the ledge 240, the rearmost portion of the bulge surface meets the ledge at an acute angle 250. In the preferred embodiment, this acute angle is about 60°, but it may range from 30 to 80° to be effective as a stress concentration feature that enables the band of the jacket to retain integrity while the portion forward of the band may fragment off upon striking a barrier.

Figure 9:
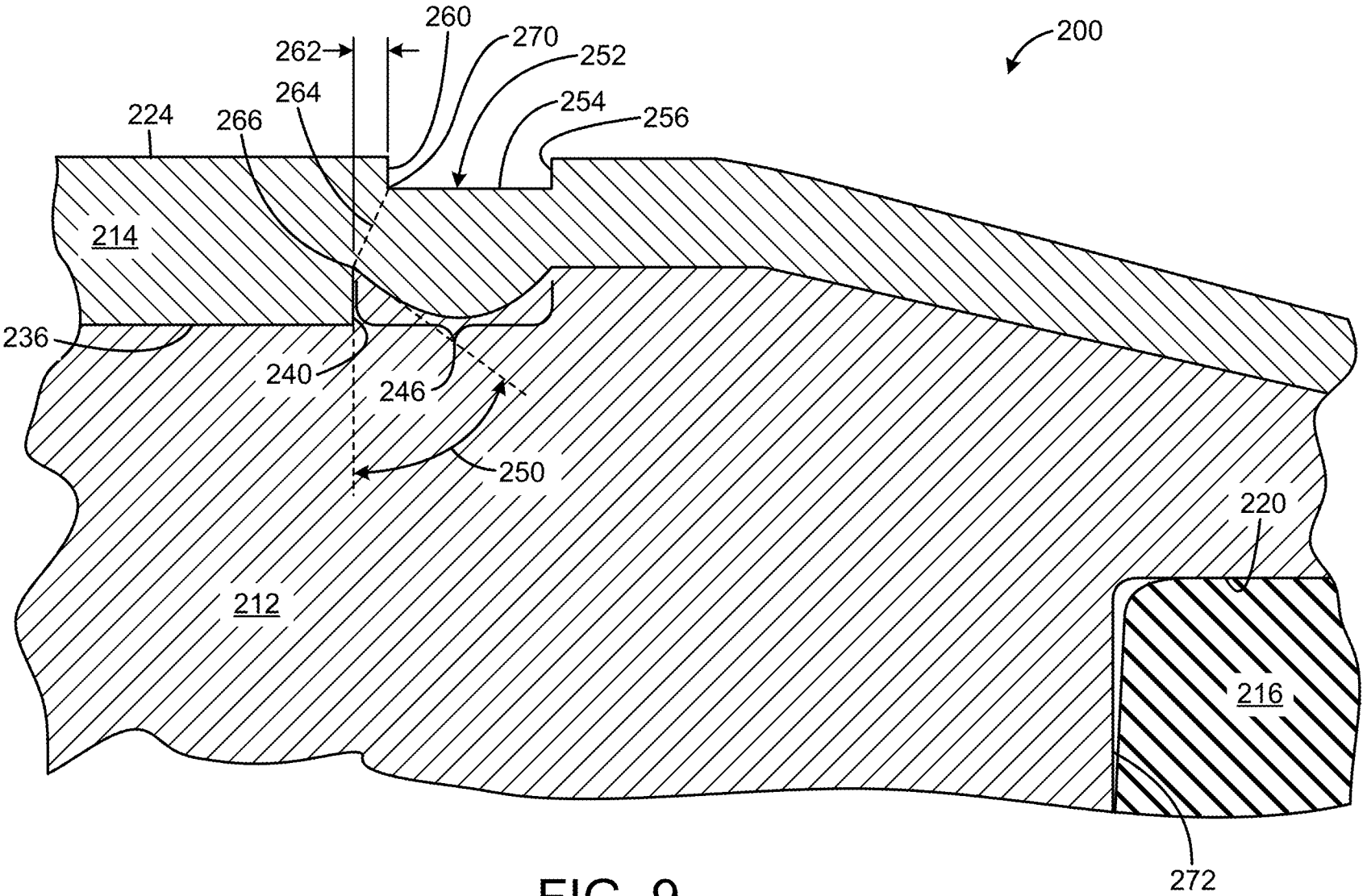
FIG. 9 is an enlarged view of the cutaway portion of the current embodiment of the 9 mm pistol bullet of FIG. 8.

As is also shown in FIG. 9, a cannelure 252 is formed as a circumferential groove with a serrated bottom 254, a flat, rear facing forward wall 256, and a flat forward facing front wall 260. The distance 262 between the rear wall 260 and the ledge 240 of the band is indicated by number 262. The cannelure rear wall is forward of the ledge, but by a limited distance of 0.005-0.015 inches.

When the distance is less than 0.005 inch, the process of forming the cannelure 252 simply crushes the jacket wall, and pushed the ledge of the band inward, so that the acute angle 250 is not formed. When the cannelure begins more than 0.010 inch forward of the ledge, then the bulge does not reach the ledge, and the angle formed is essentially square, not acute. Moreover, greater distances mean the line of fracture 264 is extended too far forward and does not provide an adequate fracture point. FIG. 9 shows the angle area with the proper dimensioning of the distance 262. In the cases where the distance is not within the optimal range, the core 212 and jacket 214 material above cannelure 252 do not break off cleanly, which results in a projectile with excessive frontal area that does not sufficiently penetrate the gelatin.

With a jacket 214 wall thickness (before canneluring) of about 0.020 inch, the distance 262 is ½ to ¼ the wall thickness. This creates a line of fracture 264 between the vertex 266 of the acute angle 250, and the rear inner corner 270 of the cannelure 252. In the preferred embodiment, the cannelure tool is provided with a sharp edge that is not relieved or rolled, so as to profile a sharp corner 270 for maximum stress concentration to facilitate breakage in this area. With the line 264 angling outward and forward, it forms an angle with respect to the sidewall of about 70°. This is preferably in the range of 45 to 80°.

Figure 10A:
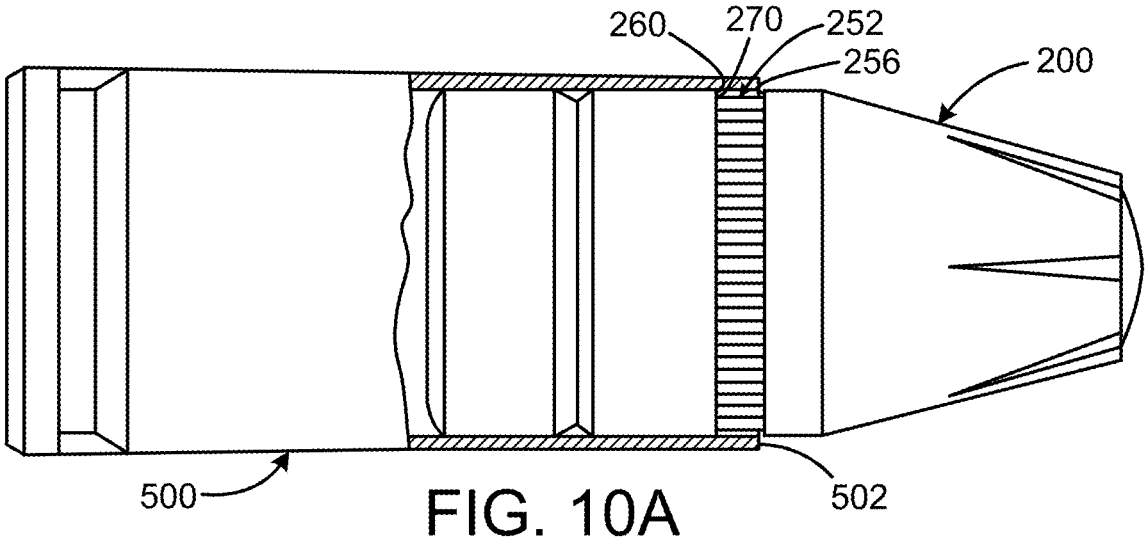
FIG. 10A is a side sectional view of the current embodiment of the 9 mm pistol bullet of FIG. 8 installed in a cartridge.
Figure 10B:
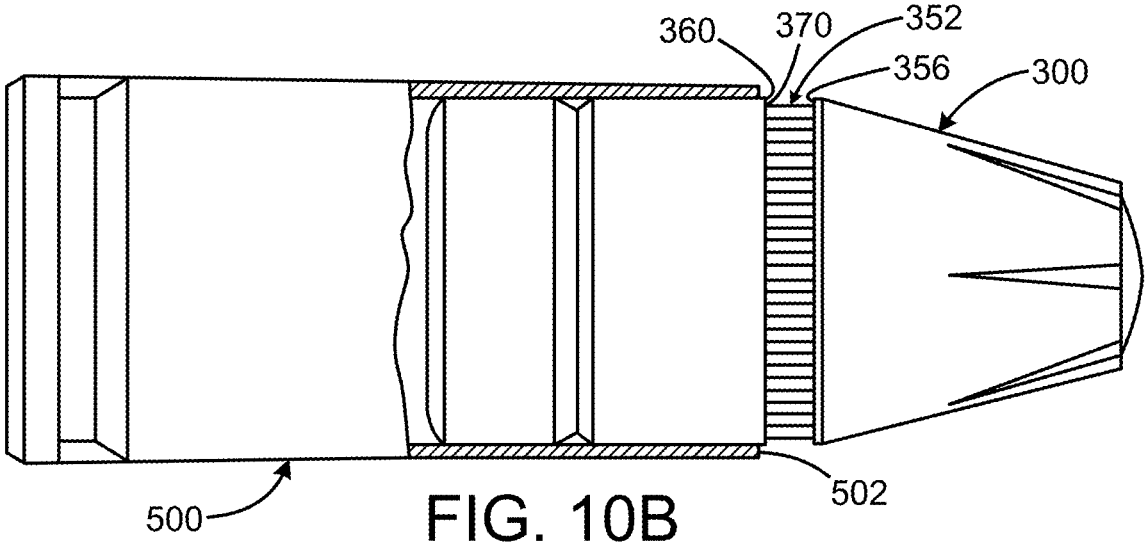
FIG. 10B is a side sectional view of an alternative embodiment of the 9 mm pistol bullet of FIG. 8 installed in a cartridge with a cannelure that entirely protrudes from the cartridge.
Figure 10C:
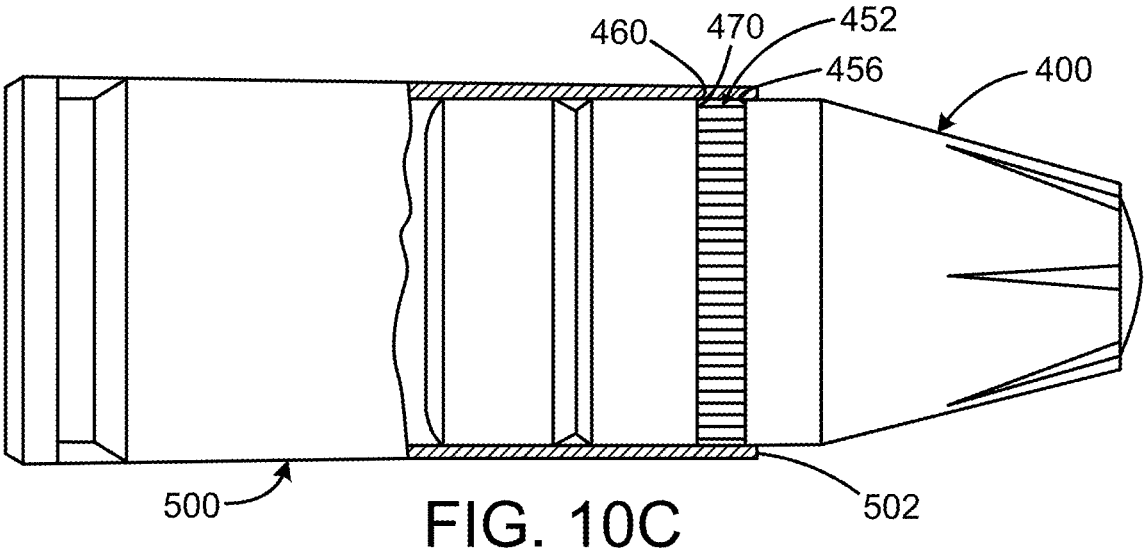
FIG. 10C is a side sectional view of an alternative embodiment of the 9 mm pistol bullet of FIG. 8 installed in a cartridge with a cannelure that is entirely received within the cartridge.

FIGS. 10A-10C show bullets 200, 300, 400 installed in a cartridge 500. In FIG. 10A, the forward wall 256 of the cannelure 252 slightly protrudes from the front opening 502 of the cartridge, and the rear wall 260 is received within the cartridge. The cartridge thickness at the front opening is 0.010 inch, and ⅓ of the case mouth front edge surface is crimped into the cannelure, while ⅔ extends radially beyond the bullet for headspacing.

Since the cannelure of the present invention does not necessarily secure the bullet into the case, which is the conventional purpose of cannelures, the cannelure can also be located forward or rearward of the front opening 502. The cannelure of the present invention is purely a means to pre-weaken the bullet and control the location of fracture/bending/deformation. In other embodiments, this weakening might optimally be in a location away from the front opening of the cartridge, based instead on the location of the internal front edge of the thick-walled band or interlock portion, or based on the location of the bottom of the nose cavity, or other geometries. FIG. 10B shows bullet 300 with a cannelure 352 that is positioned so that both the forward wall 356 and the rear wall 360 protrude beyond the front opening 502 of the cartridge. FIG. 10C shows bullet 400 with a cannelure 452 that is positioned so that both the forward wall 456 and the rear wall 460 are received within the cartridge.

The cannelure 52, 152, 252, 352, 452 on the bullets 10, 100, 200, 300, 400 is deeper than is typically necessary for a conventional cannelure. This is done to further create a stress concentration at corner 70, 170, 270, 370, 470. For rifle bullets and pistol bullets (neither of which headspace on the case mouth) a cannelure depth is typically in the range of 0.005 to 0.008 inch. For auto loading pistol bullets that headspace on the case mouth, cannelures are not typically used. If it were desired to provide such a cannelure, it would preferably be significantly shallower that the typical case mouth thickness of 0.010 to 0.012 inch, so that adequate protruding case mouth width remained for headspacing.

When the primary purpose of the cannelure 52, 152, 252, 352, 452 is not to secure the bullet 10, 100, 200, 300, 400 in the case, but to weaken the bullet in a precise location for a specific purpose, the cannelure is 0.018 to 0.027 inch deep depending on the bullet caliber. Shallower than that range will provide inadequate controlled weakening to generate predictable fracturing upon barrier impact. A deeper cannelure will disrupt the jacket 14 integrity excessively for normal purposes, including maintaining integrity upon firing and during the flight of the bullet, as well as generating premature cannelure tool wear. In the current embodiment, the cannelure preferably has a depth of greater than 40% of the width of the cannelure, and the cannelure has a depth of at least 70% of the wall thickness in which the cannelure is formed.

The ratio of the cannelure diameter to the bullet diameter can range from 0.92-0.97. The preferred ratio is 0.95 for a 0.40 caliber bullet, 0.94 for a 0.45 caliber bullet, and 0.95 for a 9 mm bullet. If the ratio exceeds about 0.965, the bullet and jacket do not fracture adequately. If the ratio is less than about 0.94, manufacturing difficulties are encountered.

The ratio of the thickness of the jacket where the nose joins the lock band can range from 0.55-0.70. The preferred ratio is 0.663 for a 0.40 caliber bullet, 0.577 for a 0.45 caliber bullet, and 0.625 for a 9 mm bullet. If the ratio is higher or lower than the specified range, the bullet's gelatin penetration performance exhibits excessive dependency on the type of barrier encountered.

The meplat diameter (the outside diameter of the nose of the bullet) for a 0.40 caliber bullet is 0.210 inch, 0.245 inch for a 0.45 caliber bullet, and 0.189 inch for a 9 mm bullet with a tolerance of +/−0.005 inch. If the meplat diameter is too large, the bullet will expand too much. If the meplat diameter is too small, the bullet will not expand enough. The meplat diameter is controlled by very small adjustments to the final swaging of the bullet into the jacket.

Figure 11B:
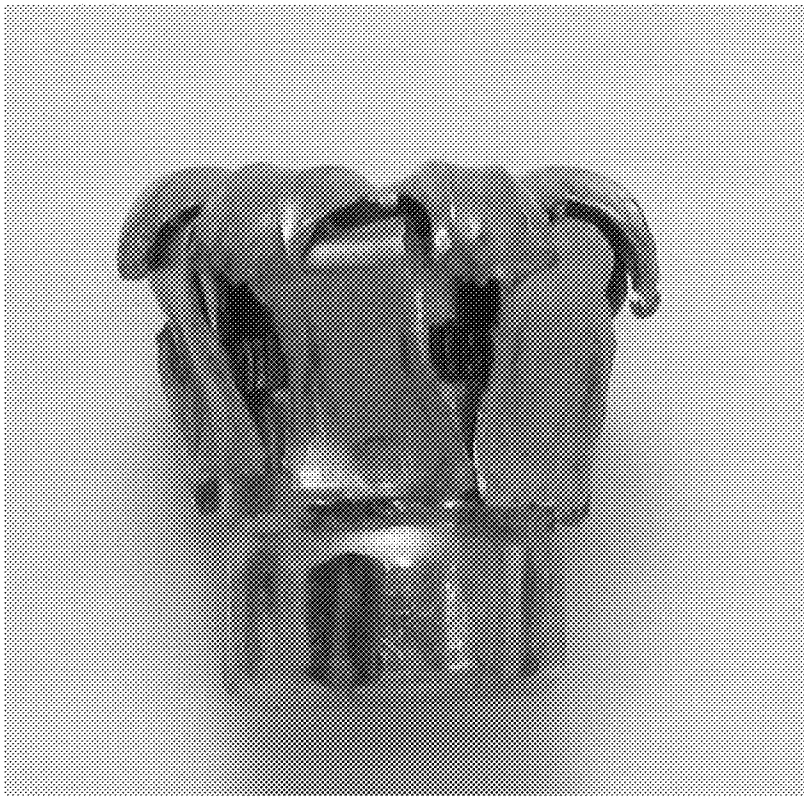
FIG. 11B is a side view of the current embodiment of the 9 mm pistol bullet of FIG. 8 after being fired at bare ballistic gelatin.
Figure 11A:
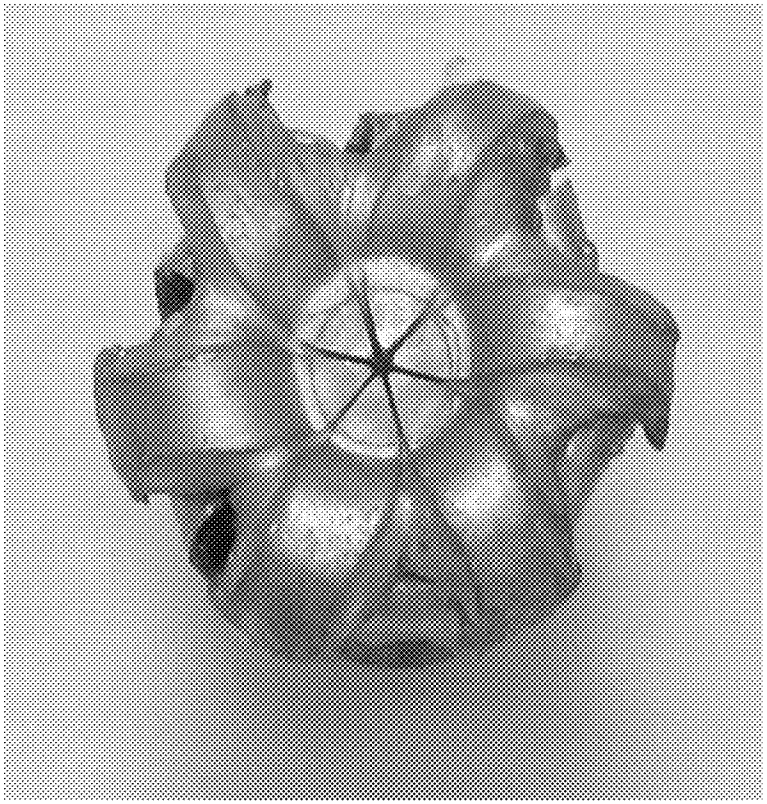
FIG. 11A is a front view of the current embodiment of the 9 mm pistol bullet of FIG. 8 after being fired at bare ballistic gelatin.
Figure 11D:
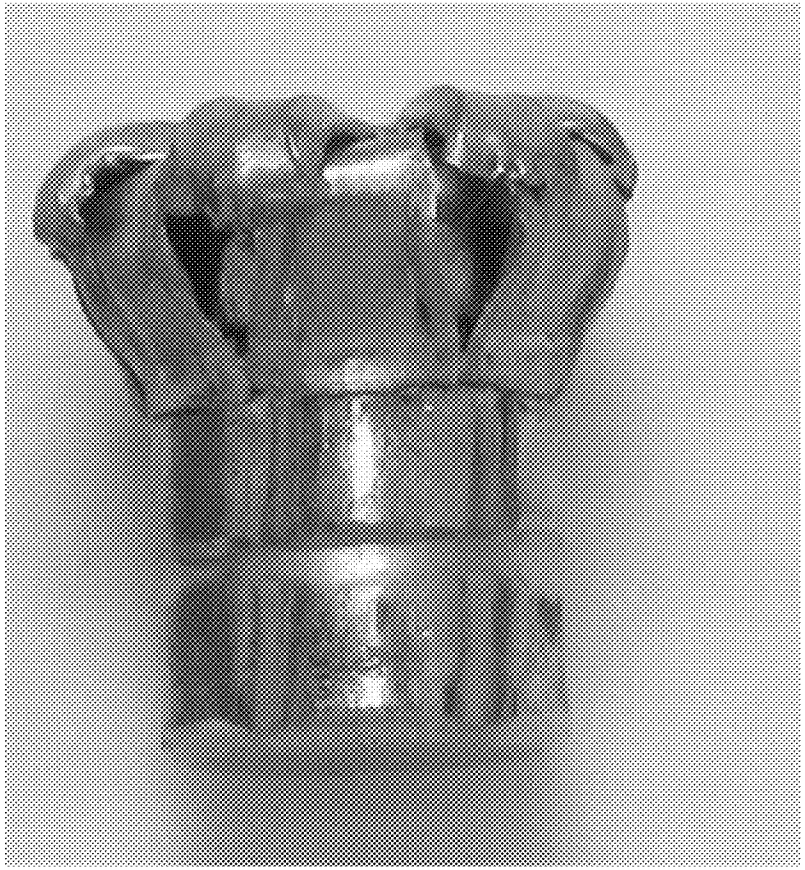
FIG. 11D is a side view of the current embodiment of the 9 mm pistol bullet of FIG. 8 after being fired at heavily clothed ballistic gelatin.
Figure 11C:
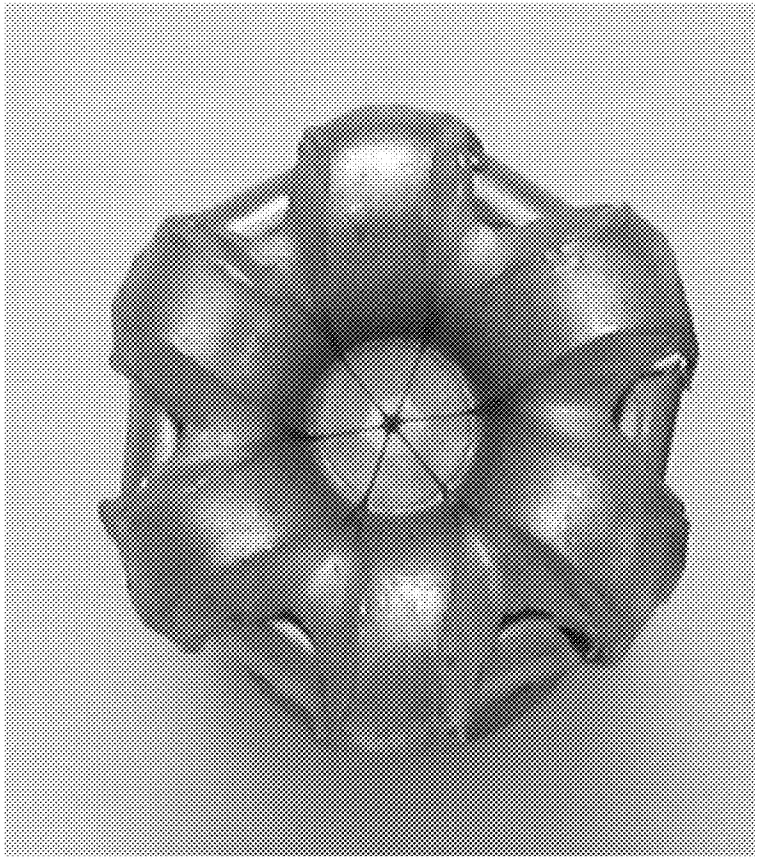
FIG. 11C is a front view of the current embodiment of the 9 mm pistol bullet of FIG. 8 after being fired at heavily clothed ballistic gelatin.
Figure 11F:
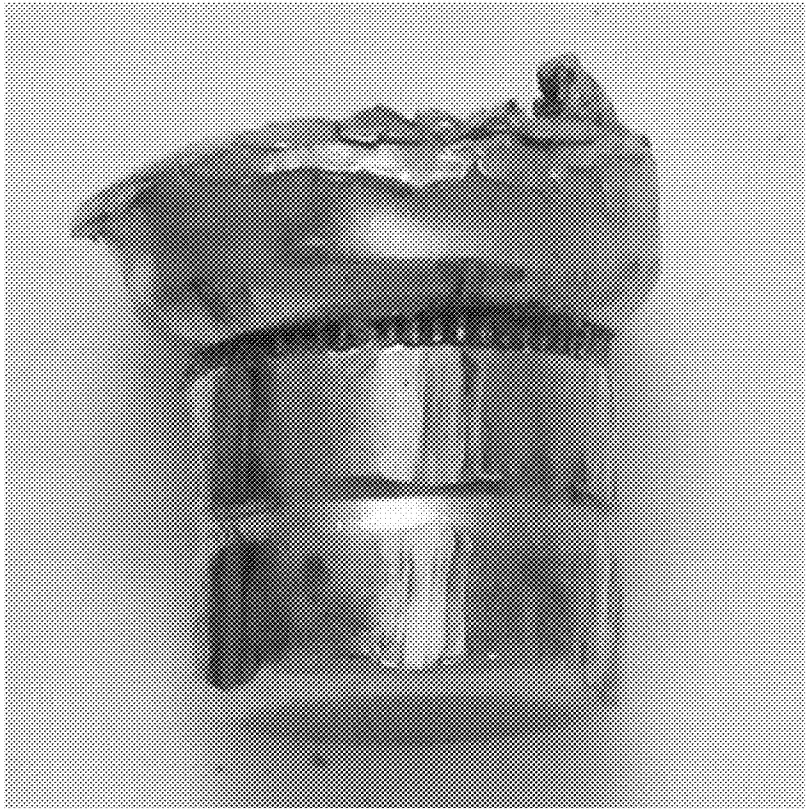
FIG. 11F is a side view of the current embodiment of the 9 mm pistol bullet of FIG. 8 after being fired at sheet metal.
Figure 11E:
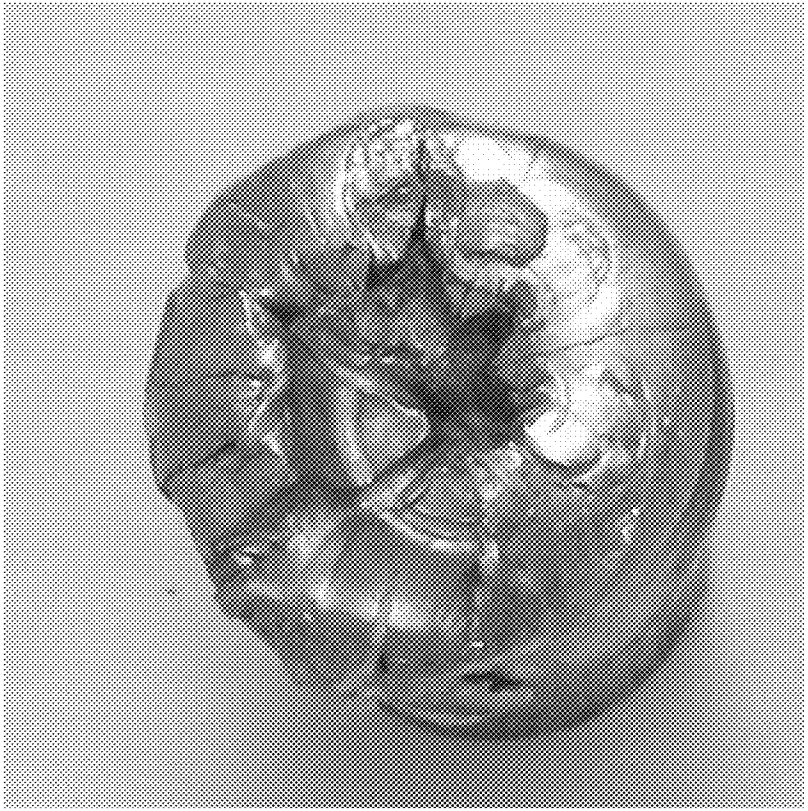
FIG. 11E is a front view of the current embodiment of the 9 mm pistol bullet of FIG. 8 after being fired at sheet metal.
Figure 11H:
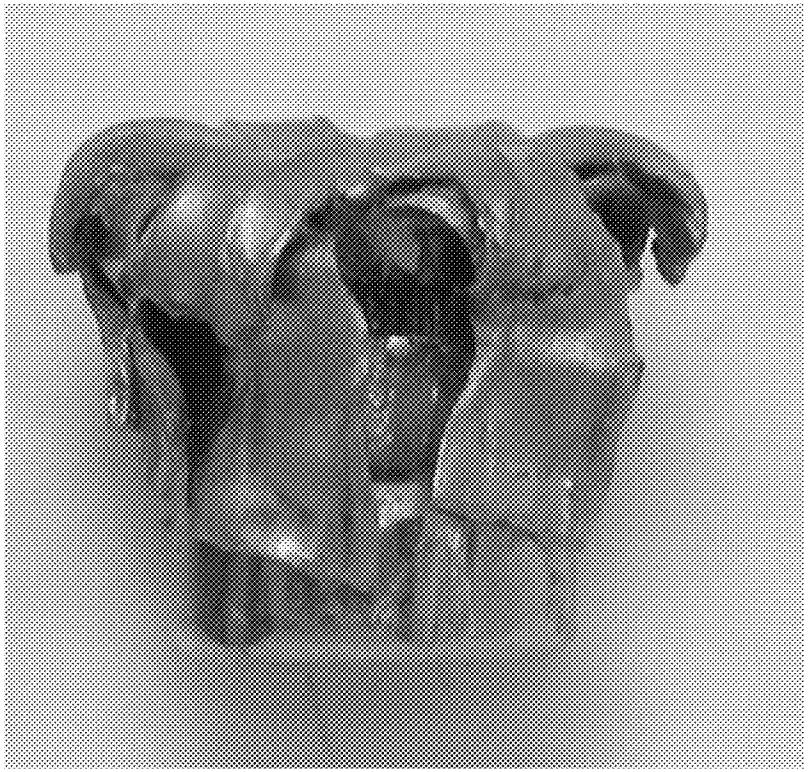
FIG. 11H is a side view of the current embodiment of the 9 mm pistol bullet of FIG. 8 after being fired at wallboard.
Figure 11G:
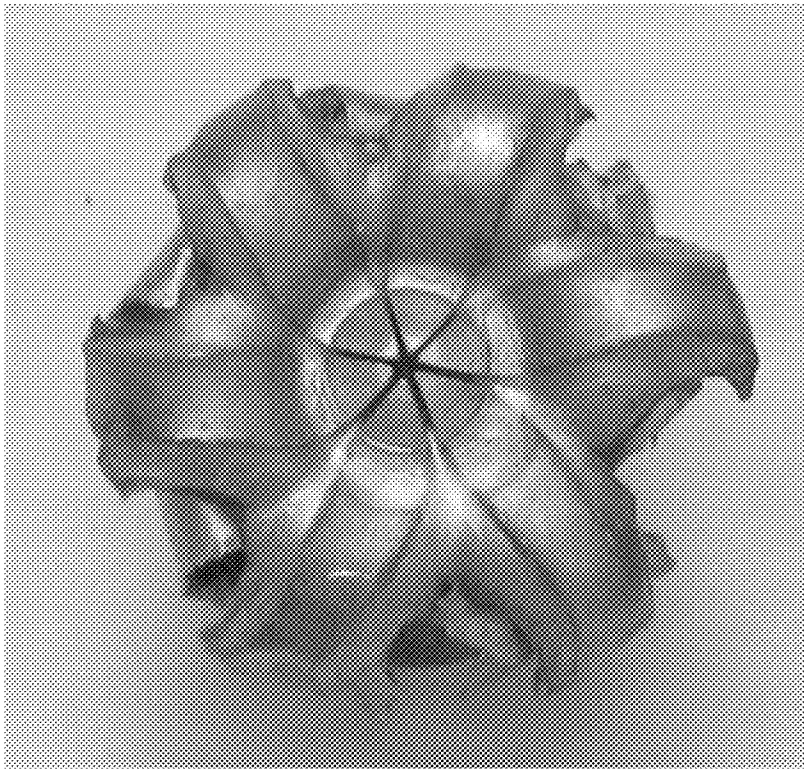
FIG. 11G is a front view of the current embodiment of the 9 mm pistol bullet of FIG. 8 after being fired at wallboard.
Figure 11J:
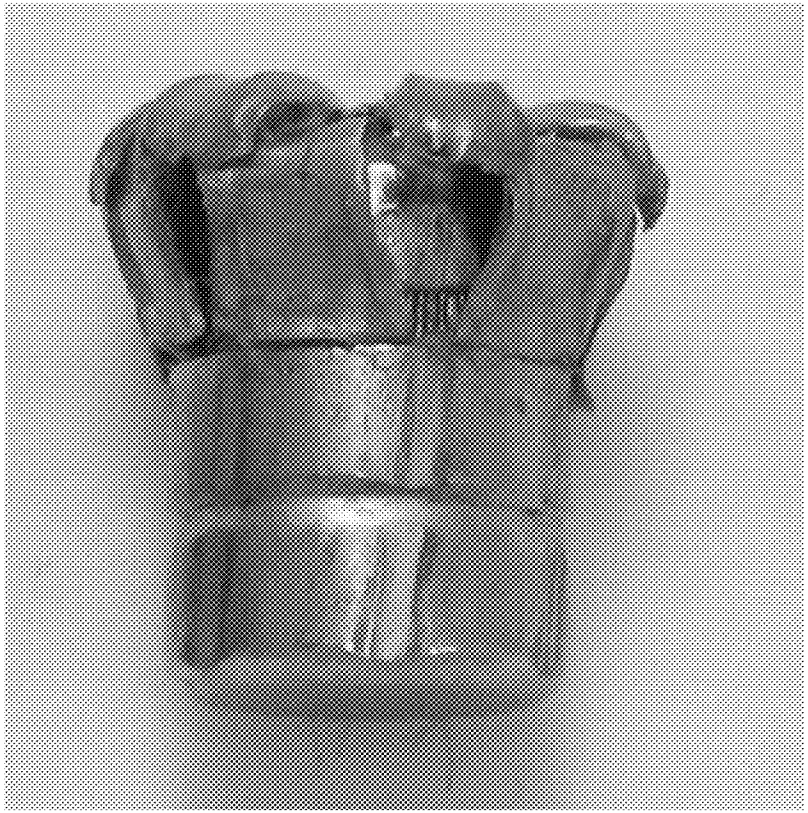
FIG. 11J is a side view of the current embodiment of the 9 mm pistol bullet of FIG. 8 after being fired at plywood.
Figure 11I:
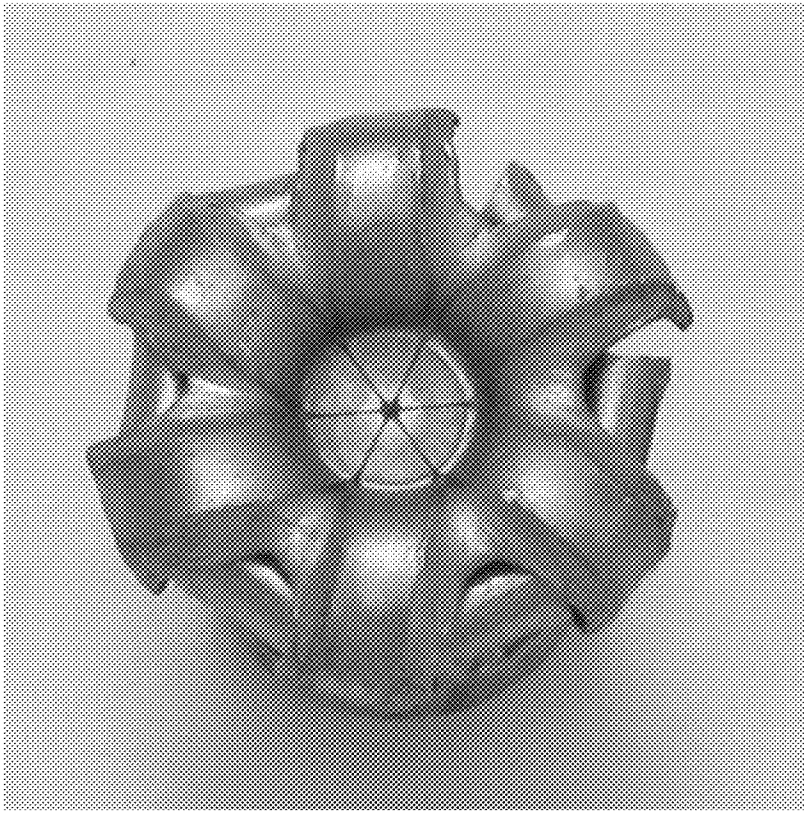
FIG. 11I is a front view of the current embodiment of the 9 mm pistol bullet of FIG. 8 after being fired at plywood.
Figure 11L:
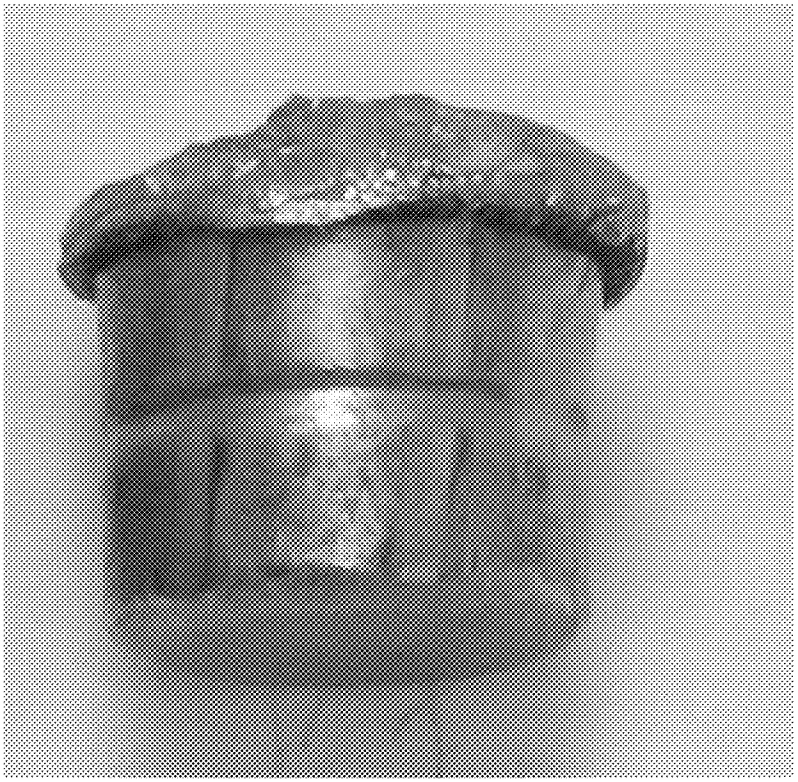
FIG. 11L is a side view of the current embodiment of the 9 mm pistol bullet of FIG. 8 after being fired at glass.
Figure 11K:
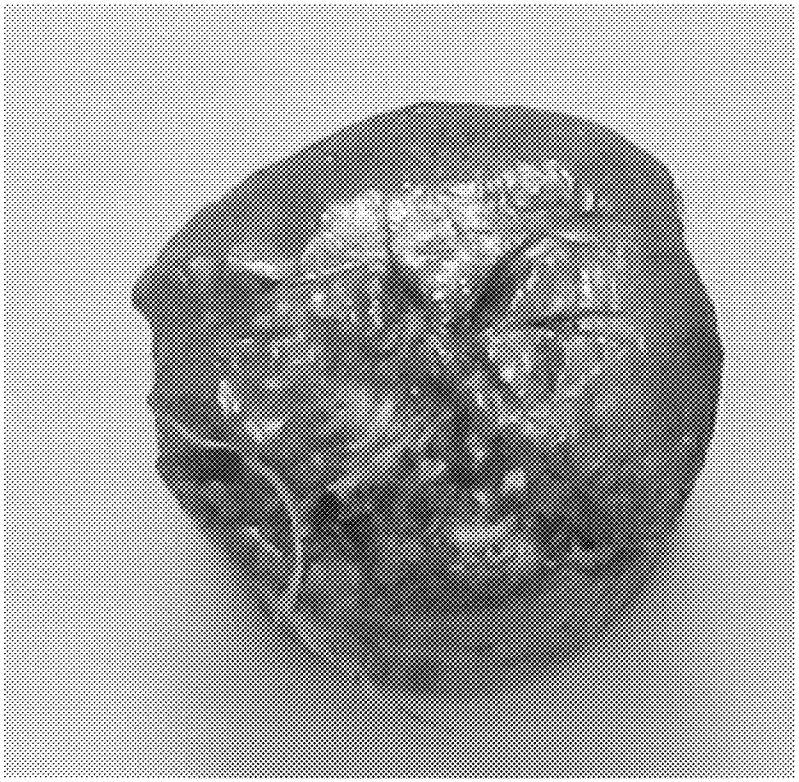
FIG. 11K is a front view of the current embodiment of the 9 mm pistol bullet of FIG. 8 after being fired at glass.

It is also noted that in the embodiments illustrated in FIGS. 1, 5, and 9 showing bullets 10, 100, 200, the bottom interior surface 72, 172, 272 of the bullet cavity is forward of the corner 70, 170, 270 of the cannelure 52, 152, 252. As is shown in FIGS. 11A-L (using the 9 mm bullet 200 as an example), positioning the bottom of the cavity forward of corner 70, 170, 270 allows the forward portion of the jacket to expand as "petals" like any other bullet on all but the hardest barriers, such as bare gelatin (FIGS. 11A-B), heavily clothed gelatin (FIGS. 11C-D), wallboard (FIGS. 11G-H), and plywood (FIGS. 11I-J). On "hard barriers," such as sheet metal and glass (FIGS. 11E-F and K-L), the bullet performs differently, but maintains its effectiveness at subsequently penetrating gelatin.

When penetrating sheet metal (typically steel), the bullet does not fragment at all. The cannelure and the jacket nose profile actually produce a controlled "mushroom" type deformation of the bullet. As a result, the gelatin is impacted by a "pre-expanded" bullet caused by penetrating the sheet metal. The jacket thickness right at the lock band and the thickness profile of the jacket to the nose control how much the bullet deforms and, therefore, the subsequent depth of gelatin penetration. The cannelure in this case provides a pre-stressed pivot point at which the jacket rotates outward and deforms. The tip prevents the cavity from closing up on the steel as conventional hollow point bullets do, and forces the jacket to deform outward, with a pivot point at the cannelure, thereby expanding.

When penetrating glass, the forward portion of the jacket 14 will fragment at corner 70 and produce a wadcutter shape projectile, consisting of the core and jacket material to the rear of the cannelure, that emerges from the hard barrier and provides adequate gelatin penetration. A conventional wadcutter bullet has a flat or nearly flat front that is typically as wide as the caliber size or only slightly smaller in diameter than caliber size.

Because of the loss of energy through the barrier, the projectile will be less likely to over penetrate, but will still provide the desired minimum effective penetration of 12". Harder barriers, like glass, will strip the petals more, yielding a more highly penetrative slug whose shape retains penetration effectiveness even after losing more energy, compared to less obstructive barriers, which will have less of an effect on the expanding portion, so that the resulting higher velocity after the barrier is compensated for by the more expanded and less penetrative bullet. This is believed to explain the unusually consistent penetration results obtained regardless of barrier type.

Table 1 shows the penetration, expansion, and recovered weight of bullets 100 (9 mm 134 gr) fired from a Glock 17 pistol at a range of 13-16".

TABLE 1

| Target type | Penetration | Expansion | Recovered weight |
|---|---|---|---|
| Bare gelatin | 14.7" | 0.537" | 133.0% |
| Heavily clothed gelatin | 15.6" | 0.511" | 133.0% |

TABLE 1-continued

| Target type | Penetration | Expansion | Recovered weight |
|---|---|---|---|
| Sheet metal | 13.9" | 0.503" | 129.9% |
| Wallboard | 13.9" | 0.537" | 133.0% |
| Plywood | 15.2" | 0.463" | 133.5% |
| Glass | 14.7" | 0.397" | 91.3% |

In the preferred embodiment, the core 12 is made of 97% lead, 3% Antimony, which is a hard alloy that does not normally expand well in the absence of the elastomeric nose insert 16. Success has been found in certain designs using lead alloys as high a 5% Antimony. However, even without the insert, or with an insert of different materials, the stress concentrations and ability to shed petals when passing through barriers provides effective expanding capability even for the preferred hard Antimony alloy.

While current embodiments of a pistol bullet have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the bullets of the current invention work with any rimless cartridge for auto-loading pistols with a muzzle velocity of up to about 1,400 f/s, including 0.357 caliber, in addition to the 9 mm Luger, 40 ACP, and 45 S&W calibers described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jacketed hollow-point bullet comprising:

a core having a forward end and a rear end and intermediate side portions extending therebetween;

the forward end of the core defining a cavity;

a jacket encompassing the rear end and at least selected portions of the sides of the core;

the jacket having a sidewall having a first portion having a first wall thickness, and a second portion immediately forward of the first portion having a second wall thickness less than the first wall thickness;

the first portion having a forward edge;

the exterior of the second portion of the jacket defining a cannelure groove at least in part encompassing the bullet;

the cannelure groove being positioned adjacent to the first portion of the jacket sidewall; and wherein the cannelure has a rear limit forward of the forward edge by a limited distance of 0.005-0.015 inches.

* * * * *